United States Patent [19]

Brefka

[11] 4,416,496

[45] Nov. 22, 1983

[54] EDGE ANCHORS FOR PRINTED CIRCUIT BOARD CONNECTORS

[76] Inventor: Paul E. Brefka, 196 Cordaville Rd., Southborough, Mass. 01772

[21] Appl. No.: 241,023

[22] Filed: Mar. 6, 1981

[51] Int. Cl.[3] ..... H01R 13/62

[52] U.S. Cl. ..... 339/17 C; 339/92 M

[58] Field of Search ..... 339/17 C, 17 L, 17 LE, 339/184 M, 186 M, 92 M

[56] References Cited

U.S. PATENT DOCUMENTS

| | | | |
|---|---|---|---|
| 2,953,767 | 9/1960 | Jackson et al. | 339/184 M X |
| 3,059,211 | 10/1962 | Thomas | 339/126 |
| 3,141,716 | 7/1964 | Armstrong | 339/92 M X |
| 3,177,461 | 4/1965 | Hagan et al. | 339/184 M |
| 3,384,864 | 5/1968 | Schwartz | 339/176 |
| 3,562,798 | 2/1971 | Bragg, Jr. | 339/17 |
| 3,582,867 | 6/1971 | Thompson | 339/92 |
| 3,848,953 | 11/1974 | Petroshanoff | 339/92 M |
| 3,966,290 | 6/1976 | Little et al. | 339/184 M X |

*Primary Examiner*—Eugene T. Desmond
*Attorney, Agent, or Firm*—Donald W. Meeker

[57] ABSTRACT

In an electrical connector provided with side openings mounted on protruding edge contacts of a printed circuit board, providing an opening through the main body of the board on each side of the protruding edge contacts. A flat-bottomed upper portion of an anchor rests on top of the board, if placed horizontally, and a pin extends downwardly from one end of the anchor through an opening in the board. A block extends downwardly from the opposite end of the anchor approximately perpendicular to the pin and distanced therefrom so that the inner face of the block is flush with the edge of the board. The outer end face of the block conforms with the outer end of the upper portion of the anchor. A cylindrical horizontal opening extends between the outer and inner faces of the block. When the connector is pushed onto the edge contacts, the connector openings align with the anchor openings, and a screw may be inserted through each aligned pair of openings to secure the connector in place. The outer end of the anchor protrusion may be deformed to secure the anchor permanently to the board. A slot may be provided in the anchor block as an extension of the horizontal opening downwardly to the bottom of the block to allow the anchor to be injection molded in plastic and easily popped out of the mold.

9 Claims, 8 Drawing Figures

EDGE ANCHORS FOR PRINTED CIRCUIT BOARD CONNECTORS

DESCRIPTION

BACKGROUND OF THE INVENTION

1. Technical Field

My invention relates to appurtenant devices specialized for use with electrical connectors and in particular to mounting means for printed circuit board sockets.

2. Background Art

The prior art multi-contact connectors attached to protruding edge contacts of printed circuit boards rely on a sliding friction fit to secure the connector to the board. Such a connection may be jarred loose by vibration, bumping the connector or the cable, or other accidental actions.

In secure cable-to-board and cable-to-cable connections, the prior art provides complex connector structures which are expensive to fabricate.

Many secure prior art connectors rely upon replacement of the existing connectors with a whole new connection system rather than adapting the existing equipment to make a more secure contact.

DISCLOSURE OF INVENTION

The present invention provides a safe anchor to secure a connector to the edge of a printed circuit board, which anchor prevents the accidental removal of the connector by vibration or other means.

The present invention provides an inexpensive anchoring device which is simply fabricated by injection molding in plastic, and easily popped off of the injector mold.

The present invention provides an anchoring device which may be applied to secure existing connectors to existing printed circuit boards, and may also be applied to secure any element to the edge of a thin board.

The present invention further provides a connector anchor which is self-securing to a printed circuit board.

The present invention further provides an easily installed means to anchor a connector to the edge of a printed circuit board by simply inserting two anchors into the printed circuit board, sliding the connector onto the protruding edge contacts, and threading a screw through the connector into each anchor. The anchor may be inserted into the printed circuit board either before or after mounting the connector.

BRIEF DESCRIPTION OF THE DRAWINGS

These and other details and advantages of my invention will be described in connection with the accompanying drawings, which are furnished only by way of illustration and not in limitation of the invention, and in which.

BEST MODE FOR CARRYING OUT THE INVENTION

Figure 1:
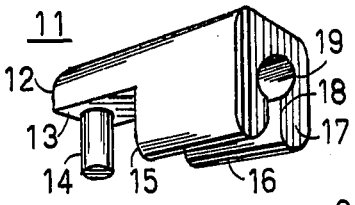
FIG. 1 is a perspective view of the preferred embodiment of the edge anchor.

In FIG. 1 the preferred embodiment of the invention is an injection molded plastic anchor 11 provided with a horizontal top portion 12 having a flat bottom 13. Extending downwardly from one end of the top portion, from the central outer edge of the flat bottom, is a protrusion in the form of a cylindrical pin 14, which is greater in length than the thickness of a printed circuit board.

Extending downwardly from the opposite end of the anchor, a receiving block 16 forms an extension of the top portion 12, the outer end of the receiving block forming a receiving face 17 coincident with the outer end of the top portion of the anchor. Opposite and approximately parallel to the receiving face 17, an inner face 15 of the block is spaced apart from the pin 14. The inner face 15 may slope slightly away from the pin 14 toward the bottom of the inner face.

An anchor opening 19, in the form of a cylindrical bore, extends between the receiving face 17 and the inner face 15. In the preferred embodiment of the anchor 11 a vertical slot 18, equal in length to the anchor opening, extends downwardly from the anchor opening 19 to the bottom of the receiving block 16. The anchor opening 19 and interconnected slot 18 form a keyhole-shaped opening through the receiving block 16. The slot 18 is provided for ease of manufacture, so that the anchor may be popped out of the mold after the injection molding process is complete.

Figure 2:
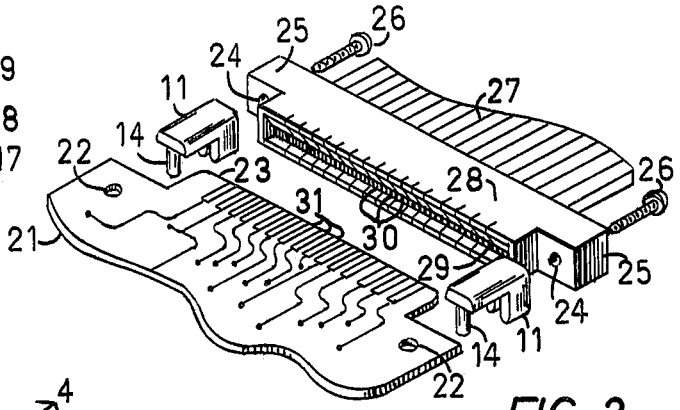
FIG. 2 is a perspective view of the printed circuit board, edge anchors, connector and screws all aligned for assembly.

In FIG. 2 a printed circuit board 21, familiar to the art, is provided along its front edge with an edge extension 23 narrower than the width of the board, which extension is provided with a series of electrical edge contacts 31. A connector 28, also familiar to the art, is provided with a connector slot 29 along its length to encompass the edge extension of the printed circuit (p.c.) board to form a friction fit. Within the connector slot 29 a series of connector contacts 30 line up with the edge contacts of the p.c. board to connect the p.c. board electrically with other elements through the band of wires 27 extending from the connector 28. The connector is further provided with two side extensions 25, each extension provided with a cylindrical connector opening 24 through each extension 25 parallel to the edge contacts 31 of the p.c. board when the connector is mounted on the board.

To apply the anchor 11 to the p.c. board 21 a board opening 22 is drilled through the main body of the board on each side of the edge extension 23. The two board openings 22 may be drilled simultaneously with the drilling of all of the other holes in the p.c. board for other components. Each board opening 22 is sufficiently large to encompass an anchor pin 14 and each board opening 22 is spaced from the front edge of the board by the distance between the pin 14 and the inner face 15 of the anchor 11.

Figure 3:
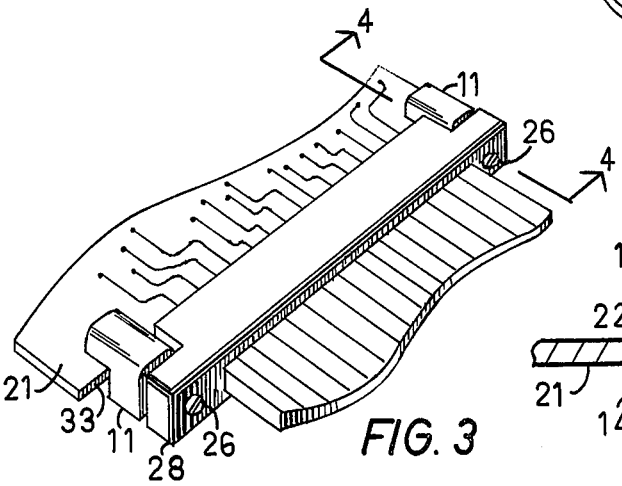
FIG. 3 is a perspective view of the connector secured to the printed circuit board by the edge anchors.
Figure 4:
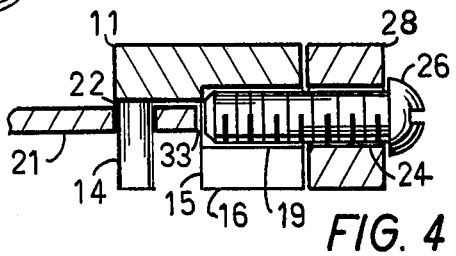
FIG. 4 is a section view of the anchor assembly taken through 4—4 of FIG. 3.

In FIGS. 3 and 4, with the p.c. board in a horizontal position, when the anchor pin 14 is inserted all the way down into the board opening 22, the flat bottom 13 of the top portion of the anchor rests on the upper surface of the p.c. board 21, and the anchor inner face 15 is flush with the front edge 33 of the p.c. board so that rotation of the anchor is prevented by the edge of the board. The outward slope of the anchor inner face 15, slightly away from the pin at the bottom, allows the anchor to slide easily into the p.c. board and fit tightly when in place.

Figure 5:
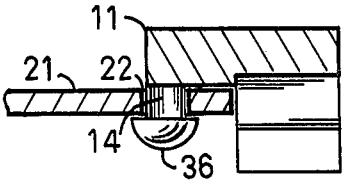
FIG. 5 is a vertical section through the longitudinal axis of an edge anchor secured to a printed circuit board.

When the connector 28 is pushed into place over the edge extension 23 of the p.c. board the connector openings 24 align with the anchor openings 19 and a screw 26 is threaded through each connector opening 24 into each anchor opening 19 to secure the connector in place on the p.c. board 21. Because the screws 26 secure the connector 28 to the anchors 11 and because the edge extension prevents vertical movement of the connector relative to the p.c. board, the pin 14 can not be pulled vertically out of the board opening after the connector is screwed into place. Therefore, the anchor pins 14 need not be secured within the board openings 22. If desired to secure the anchor to the p.c. board to prevent removal of the anchor when the connector is not in place, the end of the anchor pin may be heat-staked over to form a rivet-like head 36 in FIG. 5 to prevent removal of the pin from the board opening and retain the anchor permanently on the p.c. board. Removal of the connector is had by removing the screws 26 and pulling the connector away from the edge extension 23 of the p.c. board 21.

The anchor may be inserted in place on the p.c. board while the connector is in place on the edge extension of the board because the anchor will slide between the connector and the board. If the anchor is not permanently secured to the p.c. board the anchor may be removed when the connector screw is removed.

Figure 6:
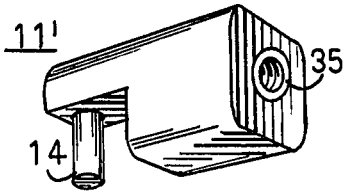
FIG. 6 is a perspective view of an alternate embodiment of the invention.

In FIG. 6 an alternate embodiment of the edge anchor 11' is provided with an internally threaded metal insert 35 in the anchor opening for applications where the connector and screws must be removed often to prevent wearing of the threads. The anchor opening is drilled into the block in this embodiment and no slot is provided; a similar opening with no slot and no metal insert could be made in the preferred embodiment with a self-threading screw. The anchor pin 14 of both alternate embodiments of FIGS. 6 and 7 would be inserted in a p.c. board opening as in the preferred embodiment. If the anchor were fabricated entirely of metal, the end of the anchor pin could be hammered over to form a head or the anchor pin could be soldered into place on the p.c. board.

Figure 7:
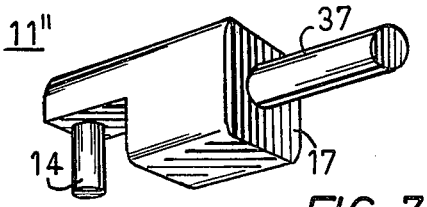
FIG. 7 is a perspective view of another alternate embodiment of the invention.

In FIG. 7 another alternate embodiment of the edge anchor 11'' provides a second protrusion, herein called a block pin 37, extending longitudinally from the outer face of the receiving block 17 in place of the block opening of the preferred embodiment. The block pin is inserted through a connector opening as the connector is installed. For a plastic anchor the outer end of the block pin would be heat-staked over to form a head to secure the connector in place permanently. For a metal anchor the end of the block pin would be hammered over to form a head or soldered in place on the connector to form a permanent connection. The embodiment of the anchor 11'' in FIG. 7 is the only embodiment which must be inserted into the p.c. board before sliding the connector into place, because of the protruding block pin which must pass through the connector opening. In all of the other embodiments the anchor may be inserted into the p.c. board either before or after mounting the connector onto the edge extension of the p.c. board.

Figure 8:
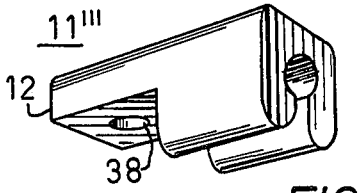
FIG. 8 is a perspective view of another alternate embodiment of the invention.

In FIG. 8 another alternate embodiment of the anchor 11''' is provided with a transverse top opening 38 through the top portion 12 of the anchor a distance from the edge of the top portion, and no anchor pin is provided as in the other embodiments. A board pin may be provided in the printed circuit board which board pin would be inserted through the top opening 38 as the anchor is lowered into place on the p.c. board. Alternately the same board opening may be provided in the p.c. board as provided in the other embodiments, and a screw threaded through the anchor top opening and the board opening to secure the anchor 11''' in place on the p.c. board.

After the connector has been securely installed on the printed circuit board by using the edge anchors of the invention, the connector may not be vibrated loose or knocked loose accidently.

Although described herein for mounting an electrical connector to a printed circuit board, the edge anchor may be used to secure anything having an opening for an attaching means to the edge of any thin board, which may be provided with an opening or a pin.

It is understood that the preceding description is given merely by way of illustration and that various modifications may be made thereto without departing from the spirit of the invention as claimed.

I claim:

1. An anchor, injection-molded in one piece, for use with an electrical connector mounted on edge contacts protruding from a printed circuit board (p.c.b.), wherein mounting holes on the connector are directly aligned with the centerline of the plane of the p.c.b. and the anchor comprises:

(a) a receiving block abutting the edge of the p.c.b.;

(b) an extension to that block over the surface of the p.c.b.;

(c) a connecting means, acting between the extension and the p.c.b. perpendicular to the p.c.b.;

(d) a horizontal, cylindrical bore aligned with the centerline of the plane of the p.c.b. and extending between an outer receiving face and an inner board-contacting face of the receiving block, designed to receive a screw which will secure the connector to the device;

(e) a vertical slot running along the length of the underside of the receiving block from the inner face to the outer face and extending upwardly to the horizontal bore as an injection mold release, the sum of which provides both a self-securing means to anchor the device to the p.c.b., without the need for additional attachment means, and a firm securing means to anchor the connector to the device, which, when simply slipped perpendicularly onto the p.c.b. and the connector slipped onto the protruding edge of the p.c.b. and screwed into the anchor, prevents horizontal movement and disconnection.

2. The anchor of claim 1 wherein the connecting means comprises a cylindrical pin protruding from the middle of the underside of the block extension, spaced apart from the junction of the block and the block extension, designed for insertion into board openings located on the p.c.b.

3. The anchor of claim 1 wherein the connecting means comprises a transverse opening situated in the middle of the block extension, extending from the underside of the block extension to the topside of the block extension, spaced apart from the junction of the block and the block extension, and designed to receive a cylindrical pin which protrudes from the p.c.b., thereby securing the anchor to the p.c.b.

4. The anchor of claim 2 wherein the inner face of the receiving block rests flush against the edge of the p.c.b. which is anterior to the pin, thereby preventing any horizontal rotation of the anchor.

5. An anchor, injection-molded in one piece, for use with an electrical connector mounted on edge contacts protruding from a printed circuit board (p.c.b.), wherein mounting holes on the connector are directly aligned with the centerline of the plane of the p.c.b. and the anchor comprises:

(a) a receiving block, provided with an outer receiving face and an inner board-contacting face abutting the edge of the p.c.b.;

(b) an extension to that block over the surface of the p.c.b.;

(c) a vertical, cylindrical pin protruding from the middle of the underside of the block extension, spaced apart from the junction of the block and the block extension, designed for insertion into board openings located on the p.c.b.;

(d) a horizontal connecting means aligned with the centerline of the plane of the p.c.b. for securing the connector to the anchor, the sum of which provides both a self-securing means to anchor the device to the p.c.b. without the need for additional attachment means, and a firm securing means to anchor the connector to the device, which, when simply slipped perpendicularly onto the p.c.b. and the connector slipped onto the protruding edge of the p.c.b. and the anchor secured to the connector, prevents horizontal movement and accidental disconnection.

6. The anchor of claim 5 wherein the horizontal connecting means comprises a cylindrical pin protruding horizontally from the outer face of the receiving block, designed for insertion into the mounting hole located on an extension of the connector, the outer end of said pin being deformed to secure the pin within the mounting hole.

7. The anchor of claim 5 wherein the horizontal connecting means comprises a horizontal, cylindrical bore aligned with the centerline of the plane of the p.c.b. and originating at the outer face of the receiving block, said bore being fabricated of a material softer than metal to enable the bore to receive and firmly retain a self-threading screw from the connector, which screw will secure the connector, and a vertical slot running along the length of the underside of the receiving block from the inner face to the outer face and extending upwardly to the horizontal bore as an injection mold release.

8. The anchor of claim 5 wherein the inner face of the receiving block rests flush against the edge of the p.c.b. which is anterior to the pin, thereby preventing any horizontal rotation of the anchor.

9. An anchor, injection-molded in one piece, for use with an electrical connector mounted on edge contacts protruding from a printed circuit board (p.c.b.), wherein the anchor comprises:

(a) a receiving block, provided with an outer receiving face and an inner board-contacting face;

(b) an extension to that block;

(c) a vertical, cylindrical pin protuding from the middle of the underside of the block extension, spaced apart from the junction of the block and the block extension, designed for insertion into board openings located on the p.c.b.;

(d) a horizontal connecting means for securing the connector to the anchor, wherein the horizontal connecting means comprises a cylindrical pin protruding horizontally from the outer face of the receiving block, designed for insertion into a cylindrical opening located on an extension of the connector, the outer end of said pin being deformed to secure the pin within the connector opening.

* * * * *